United States Patent [19]

Locke

[11] 4,105,153

[45] Aug. 8, 1978

[54] PAPERBOARD BULK BIN

[75] Inventor: Frank W. Locke, Minneapolis, Minn.

[73] Assignee: Champion International Corporation, Stamford, Conn.

[21] Appl. No.: 827,944

[22] Filed: Aug. 26, 1977

[51] Int. Cl.[2] ..... B65D 13/04

[52] U.S. Cl. ..... 229/23 R; 229/41 C

[58] Field of Search ..... 229/38, 39 R, 41 C, 229/23 R, 23 BT

[56] References Cited

U.S. PATENT DOCUMENTS

| | | | |
|---|---|---|---|
| 3,000,496 | 9/1961 | Larson | 229/41 C X |
| 3,148,444 | 9/1964 | Stark | 229/41 C X |
| 3,451,535 | 6/1969 | Caplan | 229/39 R X |
| 3,945,558 | 3/1976 | Elder | 229/23 R |
| 4,017,018 | 4/1977 | Pellaton | 229/39 R |

*Primary Examiner*—Davis T. Moorhead

*Attorney, Agent, or Firm*—Evelyn M. Sommer

[57] ABSTRACT

A paperboard bulk bin particularly suited for use in handling and transporting of large sections of meat products and the like is of two-piece construction, one portion being a side wall formed of alternating, foldably connected, rectangular upstanding side and corner panels, and a peripheral base support formed of interconnected horizontally disposed stepped flaps and locking flaps. The second portion is a bottom wall formed from a flat panel and having a perimeter corresponding to the bottom edges of the side and corner panels, and overlying the peripheral support base. The alternate stepped flaps and locking flaps are specifically designed in order to form a snap-lock peripheral base portion which holds the paperboard bulk bin in shape and is adapted to receive the bottom wall for subsequent loading and transporting of the meat products.

16 Claims, 4 Drawing Figures

PAPERBOARD BULK BIN

The subject invention relates to a new and improved paperboard bulk bin, and more particularly to a paperboard bulk bin of an irregular octagon shape made of corrugated fiberboard usually of a double wall board construction which may be readily manufactured on conventional die cutting equipment.

The subject invention is particularly concerned with a bulk bin for relatively heavy loads, such as large quantities of fresh meat which must be moved from place to place. Generally, in a centralized meat cutting operation involving mechanized cutting, packaging, and shipment of large quantities of fresh meat, heavy duty bulk bins are required, and preferably a heavy duty bulk bin that can be easily erected by a single workman in a minimum amount of time. In view of the extent of the handling and moving of the bulk bin from place to place during the shipment of the food products, the bulk bin must be rugged enough to withstand abuse, and be of sufficient strength to insure that it will not break apart during transporting.

The subject paperboard bulk bin achieves the desired objectives by virtue of a snap-lock configuration of horizontally disposed flaps which form a peripheral rigid base portion for the bulk bin, and provides support for the separate bottom wall panel which is received within the bulk bin, and supported by a peripheral base support. The paperboard bulk bin of the subject invention is formed of side walls defined by a plurality of alternating, foldably connected, substantially rectangular upstanding side and corner panels. Each corner panel includes a horizontally disposed stepped flap which is foldably connected to the bottom edge of a corner panel. Each stepped flap is of a width corresponding to the width of the associated corner panel at the bottom edge thereof, and furthermore includes a tapered tongue portion of reduced width at the free edge thereof. Each side panel has a horizontally disposed, substantially rectangular locking flap secured thereto, foldably connected to the bottom edge of the side panel. Each locking flap has opposed arcuate cutouts at the opposite side edges of the locking flap, with each cut-out being disposed intermediate the length of the side edge of the locking flap. The specific geometric relationship and design of the alternating stepped flaps and locking flaps provides an arrangement wherein said stepped flaps and locking flaps are interengaged in a snap-lock manner to form a rigid peripheral base support, extending generally horizontally, for the bulk bin. A bottom wall panel having a periphery corresponding to the bottom edges of the side panels and the corner panels is inserted into the irregular octagonal side wall and is supported by the peripheral support base. By this arrangement, a two-piece paperboard bulk bin of sturdy construction is provided, and is capable of being quickly and easily erected by a single workman. Furthermore, because of the snap-lock of the stepped flaps and locking flaps, there is no need for the use of staples, adhesives, or other fastening devices for maintaining the bottom peripheral support base in its erected rigid condition.

The two blank portions of the subject bulk bin may be readily manufactured on conventional paperboard cutting equipment, such as die cutting equipment. The panels of the subject bulk bin may be made from a paperboard blank which is formed from a single wall or double wall corrugated board.

The new and improved paperboard bulk bin of the subject invention, and the blank for forming such bulk bin, provides a container which is capable of handling heavy loads, and which may be readily and economically manufactured as well as easily and rapidly erected by a single workman.

Further objects and advantages of the subject invention will become apparent from a reading of the following detailed description taken in conjunction with the drawings in which.

Figure 1:
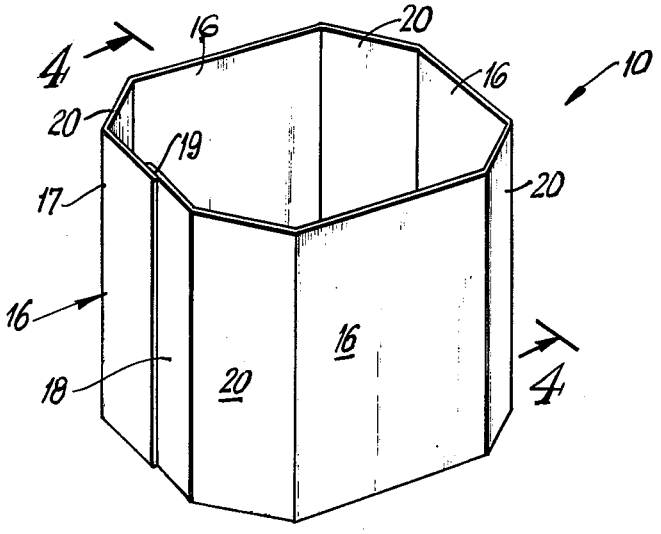
FIG. 1 is a perspective view of an erected irregular octagonal shaped paperboard bulk bin of the subject invention.
Figure 3:
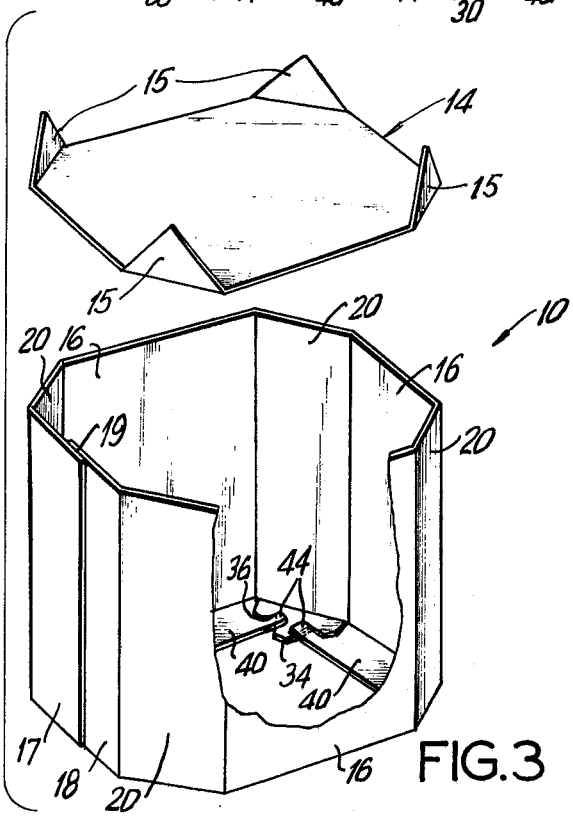
FIG. 3 is an exploded perspective view illustrating the two panel portions of the subject paperboard bulk bin.
Figure 4:
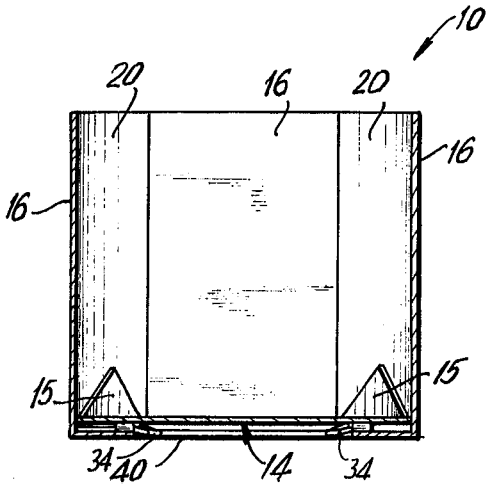
FIG. 4 is an elevational sectional view taken along line 4—4 in FIG. 1.

Referring to FIGS. 1, 3, and 4, the paperboard bulk bin of the subject invention is designated by the numeral 10, and is preferably made of a paperboard material, such as single wall or double wall corrugated boards. Bulk bin 10 is formed from two blanks, one of which forms the side wall 12, while the other forms the bottom wall 14. Side wall 12 includes upstanding, generally rectangular side panels 16 and corner panels 20 which are foldably connected, and arranged in alternating sequence as shown in FIGS. 1 and 3. One of the side walls 16 may be formed by two portions 17 and 18 which are adhesively bonded together along seam 19.

Figure 2:
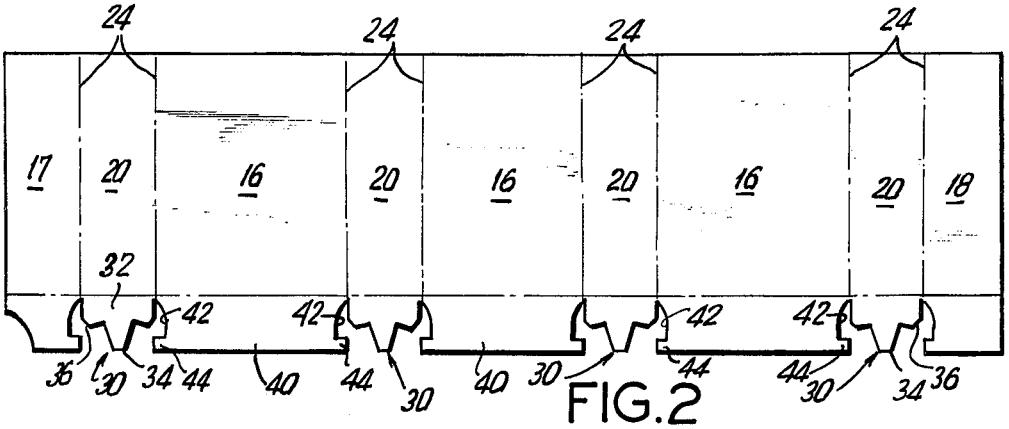
FIG. 2 is a plan view of the paperboard blank for forming the side walls and the peripheral base support of the subject bulk bin.

As shown in the paperboard blank forming the side wall 12 in FIG. 2, the side wall panels 16 and the corner wall panels 20 are hingedly connected along score lines 24, and have a common bottom score line or edge 26. Foldably connected to each corner panel 20 is a stepped flap 30 which, in the erected condition of the carton is generally horizontally disposed. Each stepped flap 30 includes a base portion 32 of a width corresponding to the width of the bottom edge of the associated corner panel, while the free edge of each tapered flap or each stepped flap 30 terminates with a tapered tongue 34. The transition between the base 32 and the tongue 34 is a tapered segment, designated by the numeral 36. Foldably connected to each side panel 16 along the bottom edge 26 thereof is a locking flap, designated by the numeral 40. Each locking flap 40 extends for a distance from the bottom score edge 26 corresponding to the distance of the stepped flap 30. The opposite edges of each locking flap 40 are cut-out as at 42. As illustrated in FIG. 2, each cut-out 42 is generally arcuate in configuration, and terminates short of the free edge of each locking flap 40 so as to define locking tabs 44 on opposite sides of each locking flap 40. The size of each cut-out 42 is slightly greater than the projection of the combination of base 32 and tapered section 36 of each stepped flap 30. This geometric relationship of the cut-outs and tabs of the locking flaps 40 and the adjacent base, tapered transition portions, and tongues 34 of the stepped flap 30 provides a snap-lock arrangement of the base portion of the side wall 12 when the carton is in the erected condition, as shown in FIGS. 3 and 4. More particularly, as shown in FIG. 3, in the erected condition of the side wall 12, the locking tabs 44 overlie the tongue 34 of the adjacent stepped flap 30, while the tapered transition portions 36 and portions of the base 32 extend through the adjacent cut-out 42 and overlie the main portion of the locking flap 40. The interengagement of the adjacent locking flaps and stepped flaps provides a snap-lock arrangement so as to provide a rigid peripheral base support for the bottom wall 14 of the subject paperboard bulk bin. As shown in FIGS. 3 and 4, the four corners 15 of the rectangular shaped bottom wall panel 14 are folded upwardly so that the bottom wall conforms to the irregular octagonal shape of the side wall 12. When fully inserted into the side wall 12, the bottom wall 14 bears against the peripheral support formed by the interengaged stepped flaps and locking flaps 40, thereby providing the desired sturdy bulk bin for accommodating heavy loads of meat products.

The snap-lock interengagement of the locking flaps and stepped flaps enables a single workman to readily and efficiently assemble the bulk bin of the subject invention, and the assembly of the bottom wall 14 into the side wall 12 cooperates to provide a sturdy construction of the resulting bulk bin.

The subject invention, and many of its intended advantages will be understood from the foregoing description, and it is apparent that various changes may be made in the form and construction of the subject paperboard bulk bin without departing from the spirit and scope of the invention as defined by the following claims.

What is claimed is:

1. A paperboard bulk bin comprising:

a side wall formed from a plurality of alternating, foldably connected, substantially rectangular upstanding side and corner panels, each corner panel having a horizontally disposed stepped flap foldably connected to the bottom edge thereof, each stepped flap being of a width corresponding to the width of the associated corner panel at the bottom edge thereof and having a tongue portion of reduced width at the opposite free edge thereof; each of said side panels having a horizontally disposed, substantially rectangular locking flap, foldably connected to the bottom edge thereof, each said locking flap having opposed cut-outs on opposite side edges thereof, each said cut-out being intermediate the length of said side edge, said stepped flaps and locking flaps being in interengaged locking relationship to form a peripheral base support for the bulk bin; and a bottom wall formed from a substantially flat, horizontally disposed panel insert having a perimeter corresponding to the bottom edges of said side and corner panels and overlying the said peripheral support base.

2. A paperboard bulk bin as in claim 1 wherein the tongue portion of each step flap is tapered.

3. A paperboard bulk bin as in claim 1 wherein the cut-outs of each locking flap are arcuate.

4. A paperboard bulk bin as in claim 1 wherein each stepped flap is tapered intermediate the tongue and the portion thereof which is of a width corresponding to the width of the associated corner panel.

5. A paperboard bulk bin as in claim 1 wherein the opposite free edges of each locking flap include generally rectangular tab portions.

6. A paperboard bulk bin as in claim 1 wherein one of said side panels is formed of two portions adhesively bonded together.

7. A paperboard bulk bin as in claim 1 wherein said bin is formed from a single wall corrugated board.

8. A paperboard bulk bin comprising:

a side wall formed from a plurality of alternating, foldably connected, substantially rectangular upstanding side and corner panels, each corner panel having a horizontally disposed stepped flap foldably connected to the bottom edge thereof, each stepped flap being of a width corresponding to the width of the associated corner panel at the bottom edge thereof and a tapered tongue portion of reduced width at the opposite free edge thereof; each of said side panels having a horizontally disposed, substantially rectangular locking flap, foldably connected to the bottom edge thereof, each said locking flap having opposed arcuate cut-outs at opposite side edges thereof, each said cut-out being intermediate the length of side edge, and with the free edges of said locking flap including tab portions of generally rectangular configuration, said stepped flaps and locking flaps being in interengaged locking relationship such that said rectangular tabs overlie the tapered tongue portion of the contiguous stepped flap to form a peripheral base support for a bulk bin; and a bottom wall formed from a substantially flat, horizontally disposed panel insert having a perimeter corresponding to the bottom edges of said side and corner panels and overlying said peripheral support base.

9. A paperboard bulk bin as in claim 8 wherein said bin is formed from a single wall corrugated board.

10. A paperboard bulk bin as in claim 8 wherein one side panel is formed of two portions adhesively bonded together.

11. A paperboard bulk bin as in claim 1 wherein the four edges of said panel inserts are folded upwardly to conform to the angular relationship between said corner flaps and the adjacent side panels.

12. A paperboard blank for a bulk bin, which comprises:

a plurality of alternating, foldably connected, substantially rectangular side panels and corner panels, each corner panel having a stepped flap foldably connected to the bottom edge thereof, each stepped flap being of a width corresponding to the width of the associated corner panel at the bottom edge thereof and having a tongue portion of reduced width at the opposite free edge thereof; each said side panel having a substantially rectangular locking flap foldably connected to the bottom edge thereof, each said locking flap having opposed cut-outs at the opposite side edges thereof, each said cut-out being intermediate the length of said side edge; and said foldably connected side panels, corner panels, stepped flaps and locking flaps being connected along scored, fold lines.

13. A paperboard blank for a bulk bin as in claim 11 wherein said blank is formed of a single wall corrugated board.

14. A paperboard bulk bin as in claim 1 wherein said bin is formed from a double wall corrugated board.

15. A paperboard bulk bin as in claim 8 wherein said bin is formed from a double wall corrugated board.

16. A paperboard blank for a bulk bin as in claim 11 wherein said blank is formed of a double wall corrugated board.

* * * * *